US008731451B2

(12) United States Patent
Hayashi et al.

(10) Patent No.: US 8,731,451 B2
(45) Date of Patent: May 20, 2014

(54) FIXING DEVICE AND IMAGE FORMING APPARATUS WITH FIXING BELT REFRESHING ROLLER

(75) Inventors: Yoshihiro Hayashi, Kanagawa (JP); Toshiyuki Miyata, Kanagawa (JP); Keita Yano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 78 days.

(21) Appl. No.: 13/452,391

(22) Filed: Apr. 20, 2012

(65) Prior Publication Data

US 2013/0164054 A1 Jun. 27, 2013

(30) Foreign Application Priority Data

Dec. 27, 2011 (JP) ..... 2011-286894

(51) Int. Cl.
*G03G 15/20* (2006.01)

(52) U.S. Cl.
USPC ..... 399/329

(58) Field of Classification Search
USPC ..... 399/320, 328, 329, 347; 219/216
See application file for complete search history.

(56) References Cited

U.S. PATENT DOCUMENTS

| | | | | |
|---|---|---|---|---|
| 6,192,214 | B1 * | 2/2001 | Kim et al. | 399/348 |
| 2006/0093411 | A1 * | 5/2006 | Watanabe et al. | 399/327 |
| 2007/0003334 | A1 * | 1/2007 | Shinshi et al. | 399/327 |
| 2008/0038027 | A1 | 2/2008 | Ito et al. | |

FOREIGN PATENT DOCUMENTS

| | | | |
|---|---|---|---|
| JP | 2007003985 A | * | 1/2007 |
| JP | 2008-40363 A | | 2/2008 |
| JP | 2011085636 A | * | 4/2011 |
| JP | 2011197357 A | * | 10/2011 |

* cited by examiner

*Primary Examiner* — Robert Beatty
(74) *Attorney, Agent, or Firm* — Sughrue Mion, PLLC

(57) ABSTRACT

A fixing device includes a heater that transports a recording medium while rotating in a first direction and fixes an image formed on the recording medium to the recording medium by heating the image, a reducing member that rotates in a second direction different from the first direction, the reducing member and the heater contacting each other and rotating at different speeds, and the reducing member scratching an outer peripheral surface of the heater, and a moving device that moves the heater with respect to the reducing member in a direction of a rotational axis of the reducing member.

10 Claims, 6 Drawing Sheets

FIXING DEVICE AND IMAGE FORMING APPARATUS WITH FIXING BELT REFRESHING ROLLER

CROSS-REFERENCE TO RELATED APPLICATIONS

This application is based on and claims priority under 35 USC 119 from Japanese Patent Application No. 2011-286894 filed Dec. 27, 2011.

BACKGROUND

The present invention relates to a fixing device and an image forming apparatus.

SUMMARY

According to an aspect of the present invention, a fixing device includes a heater that transports a recording medium while rotating in a first direction and fixes an image formed on the recording medium to the recording medium by heating the image, a reducing member that rotates in a second direction different from the first direction, the reducing member and the heater contacting each other and rotating at different speeds, and the reducing member scratching an outer peripheral surface of the heater, and a moving device that moves the heater with respect to the reducing member in a direction of a rotational axis of the reducing member.

BRIEF DESCRIPTION OF THE DRAWINGS

An exemplary embodiment of the present invention will be described in detail based on the following figures, wherein.

DETAILED DESCRIPTION

Figure 1:
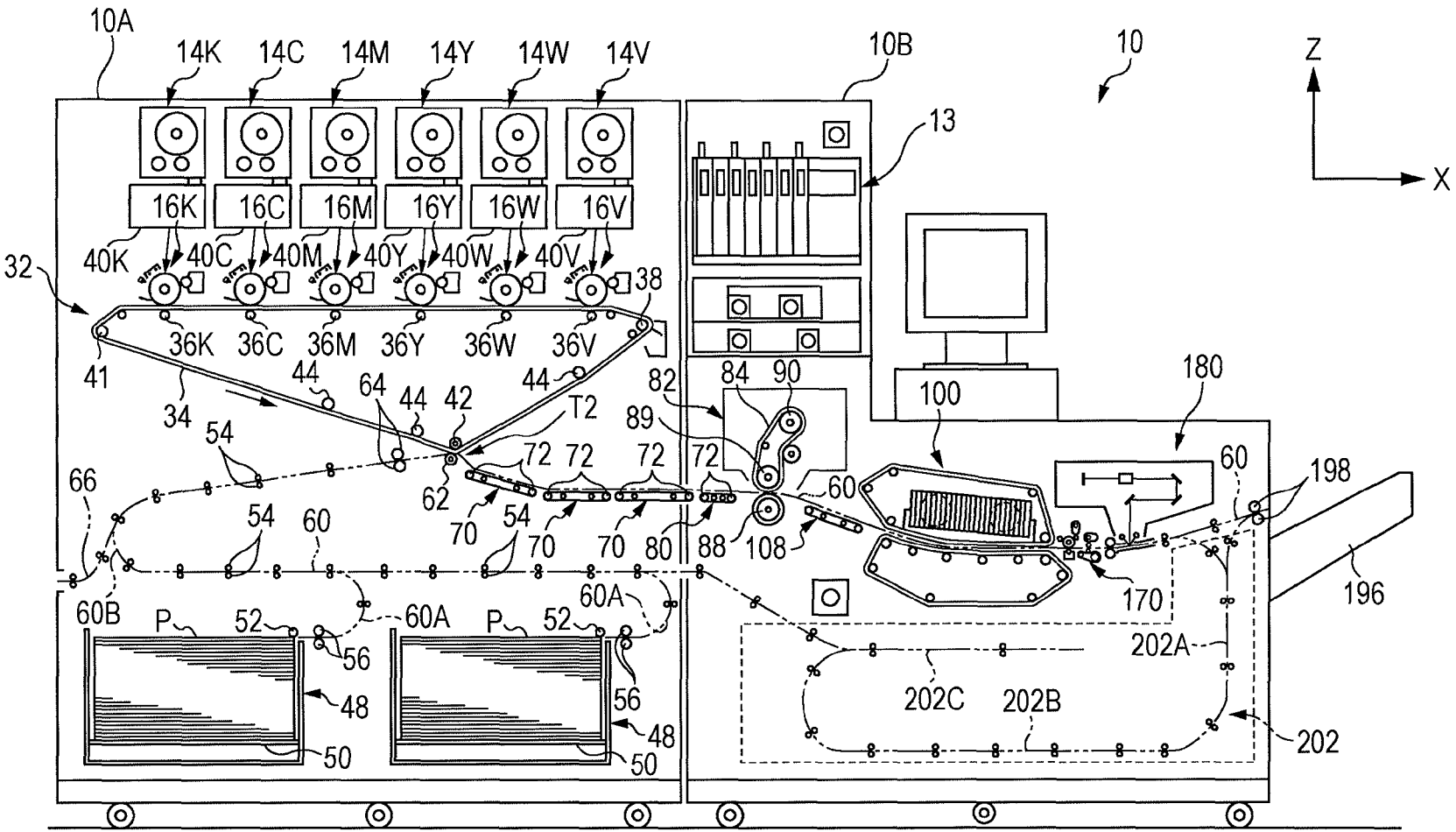
FIG. 1 is a schematic diagram illustrating a configuration of an image forming apparatus according to an exemplary embodiment of the present invention.

Referring to the drawings, an exemplary embodiment of the present invention will be described below.

Configuration of Image Forming Apparatus According to Exemplary Embodiment

Firstly, a configuration of an image forming apparatus 10 according to the exemplary embodiment will be described. FIG. 1 is a schematic diagram illustrating a configuration of the image forming apparatus 10 according to the exemplary embodiment.

The image forming apparatus 10 according to the exemplary embodiment is an apparatus that forms a color image or a monochrome image. As illustrated in FIG. 1, the image forming apparatus 10 includes a first housing 10A and a second housing 10B. The first housing 10A forms a first-side (a left side in FIG. 1) portion of the image forming apparatus 10 in the horizontal direction. The second housing 10B is detachably joined to the first housing 10A and forms a second-side (a right side in FIG. 1) portion of the image forming apparatus 10 in the horizontal direction.

An image signal processor 13, which performs image processing on image data transmitted from an external device, such as a computer, is disposed at an upper portion of the second housing 10B.

Toner cartridges 14V, 14W, 14Y, 14M, 14C and 14K, which respectively contain toners of a first extra color (V), a second extra color (W), yellow (Y), magenta (M), cyan (C), and black (K), are arranged in the horizontal direction at an upper portion of the first housing 10A so as to be replaceable.

Any color, including transparent, other than yellow, magenta, cyan, and black may be appropriately selected as the first extra color or the second extra color. In the following description, any one of suffixes V, W, Y, M, C, and K is added to corresponding reference signs in the case where components corresponding to the first extra color (V), the second extra color (W), yellow (Y), magenta (M), cyan (C), and black (K) need to be distinguished from one another. In the case where components corresponding to the first extra color (V), the second extra color (W), yellow (Y), magenta (M), cyan (C), and black (K) do not need to be distinguished from one another, the suffix V, W, Y, M, C, or K is not added to the reference signs.

Multiple image forming units 16, each forming an image, are arranged in the horizontal direction below the toner cartridges 14 so as to correspond to the toner cartridges 14. In this exemplary embodiment, six image forming units 16 are provided so as to correspond to the toners of different colors. Each image forming unit 16 is provided with an exposure unit 40 between the image forming unit 16 and a corresponding toner cartridge 14.

Each exposure unit 40 receives image data, which has been subjected to image processing by the image signal processor 13, from the image signal processor 13 and radiates a photoconductor 18, which will be described below (see FIG. 2), with exposure light L (see FIG. 2) that has been modulated in accordance with the image data.

Figure 2:
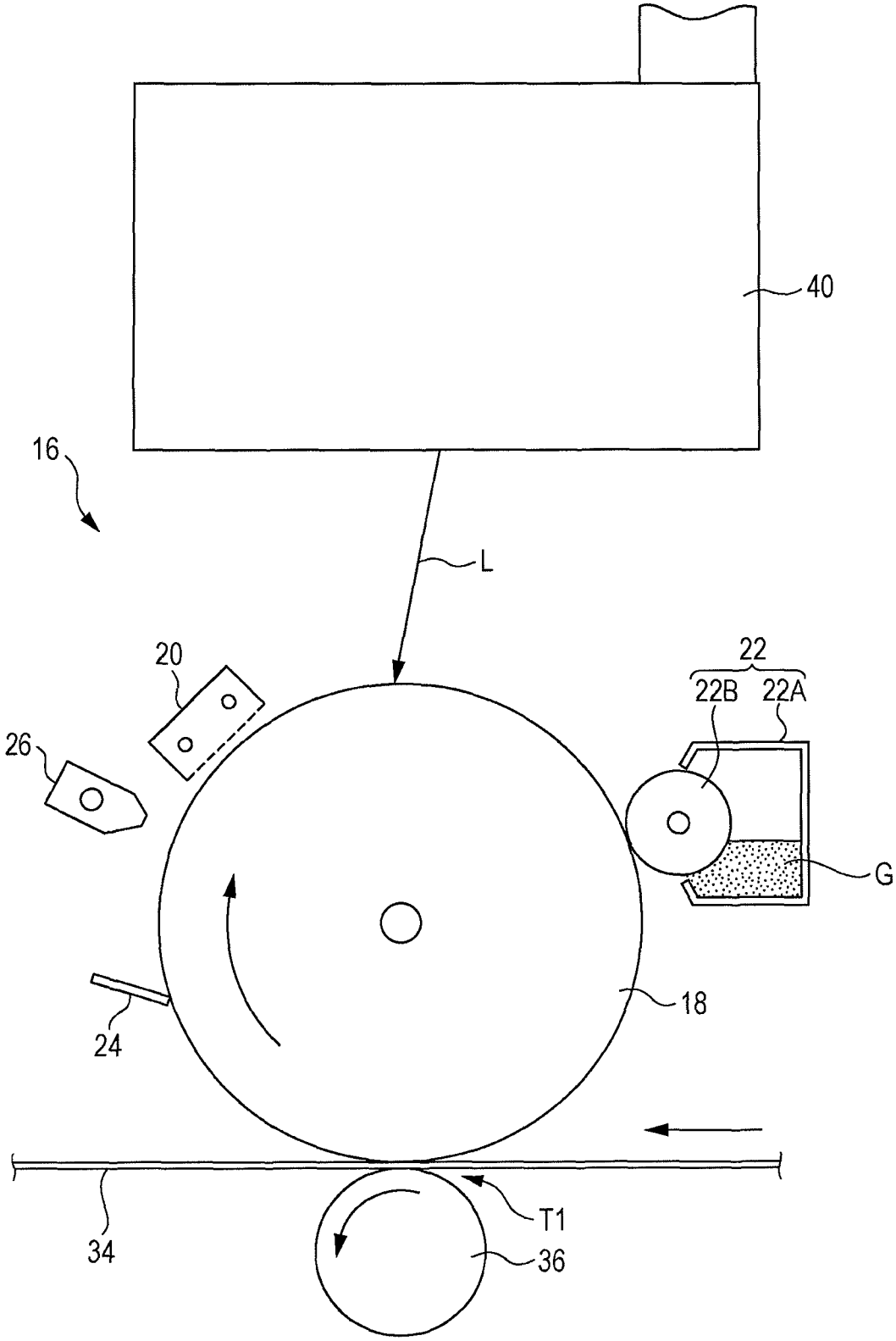
FIG. 2 is a schematic diagram illustrating a configuration of an image forming unit according to the exemplary embodiment.

As illustrated in FIG. 2, each image forming unit 16 includes a photoconductor 18 that is driven so as to rotate in one direction (clockwise direction in FIG. 2). A scorotron charger 20, a developing device 22, a blade 24, and a static eliminator 26 are disposed around the photoconductor 18. The scorotron charger 20 is a corona discharge type (non-contact type) charger and is an example of a charging device that charges the photoconductor 18. The developing device 22 develops an electrostatic latent image, which is formed when the photoconductor 18 charged by the scorotron charger 20 is radiated with exposure light L by the exposure unit 40, with a developer. The blade 24 is an example of a removing member that removes part of the developer remaining on the photoconductor 18 after a transfer operation. The static eliminator 26 eliminates the static on the photoconductor 18, which is subjected to a transfer operation, by radiating the photoconductor 18 with light.

The scorotron charger 20, the developing device 22, the blade 24, and the static eliminator 26 face the surface of the photoconductor 18, and are arranged in this order from an upstream side to a downstream side in a direction of rotation of the photoconductor 18.

The developing device 22 includes a developer containing member 22A, which contains a developer G containing a toner, and a developing roller 22B that supplies the developer G contained in the developer containing member 22A to the photoconductor 18. The developer containing member 22A is connected to a corresponding toner cartridge 14 (see FIG. 1) via a toner supply passage (not illustrated), through which a toner is supplied from the toner cartridge 14 to the developer containing member 22A.

As illustrated in FIG. 1, a transfer unit 32, which transfers toner images formed by the image forming units 16 to a recording medium P, is disposed below the image forming units 16. The transfer unit 32 includes an intermediate transfer belt 34, first transfer rollers 36, and a second transfer roller 62. The intermediate transfer belt 34 is an example of a circular transfer body. The first transfer rollers 36 are examples of a transfer member that transfers toner images formed on the photoconductors 18 of the image forming units 16 to the intermediate transfer belt 34. The second transfer roller 62 is an example of a transfer member that transfers the toner images on the intermediate transfer belt 34 to a recording medium P.

As illustrated in FIG. 2, each first transfer roller 36 is disposed at such a position as to face the photoconductor 18 of a corresponding image forming unit 16 with the intermediate transfer belt 34 interposed therebetween. A transfer bias voltage with a polarity that is opposite the polarity of the toner is applied to the first transfer roller 36 by a power supply unit (not illustrated). With this configuration, a toner image formed on the photoconductor 18 is transferred to the intermediate transfer belt 34 at a predetermined first transfer position T1. To be more specific, the first transfer position T1 is a position at which the intermediate transfer belt 34 and the photoconductor 18 are in contact with each other.

As illustrated in FIG. 1, the intermediate transfer belt 34 is wound around a driving roller 38, a tension roller 41, an opposing roller 42, and multiple support rollers 44. The driving roller 38 is driven by a motor that is not illustrated. The tension roller 41 tensions the intermediate transfer belt 34. The opposing roller 42 is disposed so as to oppose the second transfer roller 62. The intermediate transfer belt 34 rotationally moves in one direction (counter-clockwise direction in FIG. 1) together with rotation of the driving roller 38. Toner images that have been transferred to the intermediate transfer belt 34 at first transfer positions T1 (see FIG. 2) are transported to a predetermined second transfer position T2 by the rotational movement of the intermediate transfer belt 34.

A transfer bias voltage with a polarity that is opposite the polarity of the toner is applied to the second transfer roller 62 by a power supply portion (not illustrated). When the transfer bias voltage is applied to the second transfer roller 62, the second transfer roller 62 transfers the toner images, which have been transported to the second transfer position T2 by the intermediate transfer belt 34, to a recording medium P at the second transfer position T2.

As described above, in this exemplary embodiment, the image forming units 16, which each form a toner image, and the transfer unit 32, which transfers the toner images formed by the image forming units 16 to a recording medium P, function as an example of an image forming device that forms an image on a recording medium.

Two recording-medium containing portions 48 that contain recording media, such as sheets, are arranged in the horizontal direction below the transfer unit 32. Each recording-medium containing portion 48 is dismountable from the first housing 10A by being drawn out. Each recording-medium containing portion 48 is provided with a pick-up roller 52, which feeds a recording medium P from the recording-medium containing portion 48 to a transport path 60, at a position above an end portion (right portion in FIG. 1) of the recording-medium containing portion 48.

A bottom plate 50 on which recording media P are placed is disposed inside each recording-medium containing portion 48. The bottom plate 50 is lowered in accordance with an instruction of a controlling device, which is not illustrated, when the recording-medium containing portion 48 is drawn from the first housing 10A. After the bottom plate 50 has been lowered, a space, which is to be replenished with recording media P by a user, is generated in the recording-medium containing portion 48.

When the recording-medium containing portion 48 drawn from the first housing 10A is mounted to the first housing 10A, the bottom plate 50 is raised in accordance with an instruction of the controlling device. After the bottom plate 50 has been raised, a topmost one of the recording media P placed on the bottom plate 50 comes into contact with a corresponding pick-up roller 52.

Separation rollers 56, which separate recording media P that are fed in an overlapping manner from each recording-medium containing portion 48 into individual sheets, are disposed on a side that is further downstream in a direction of transporting the recording media (also simply referred to as "the downstream side", below) than a corresponding pick-up roller 52. Multiple transport rollers 54, which transport the recording media P to the downstream side in the transporting direction, are disposed on the downstream side of the separation rollers 56.

The transport path 60, which is formed so as to connect the recording-medium containing portions 48 and the transfer unit 32, extends to the second transfer position T2 that is between the second transfer roller 62 and the opposing roller 42 such that the recording media P fed from the recording-medium containing portions 48 are turned to the left in FIG. 1 at first bending portions 60A and such that the recording media P are turned to the right in FIG. 1 at a second bending portion 60B. Transport rollers (registration rollers) 64, which make an adjustment such that the recording medium P and the toner images are transported to the second transfer position T2 at the same timing, are disposed further upstream in the transporting direction than the second transfer position T2.

A preliminary path 66 extends from a side surface of the first housing 10A and joins the second bending portion 60B of the transport path 60. A recording medium P fed from a recording-medium containing portion (not illustrated) that is disposed so as to be adjacent to the first housing 10A travels along the preliminary path 66 and is fed to the transport path 60.

Multiple transport belts 70, which transport a recording medium P having had toner images transferred thereto toward the second housing 10B, are disposed in the first housing 10A on the downstream side of the second transfer position T2. A transport belt 80, which transports the recording medium P that has been fed from the transport belts 70 to the downstream side, is disposed in the second housing 10B.

Each of the multiple transport belts 70 and the transport belt 80 is circularly formed, and is wound around a pair of winding rollers 72. One of the paired winding rollers 72 is disposed on the upstream side in the transporting direction of the recording medium P, and the other, on the downstream side. One of the paired winding rollers 72 is driven so as to rotate to rotationally move a corresponding transport belt 70 (or transport belt 80) in a single direction (clockwise direction in FIG. 1).

A fixing device 82 is disposed on the downstream side of the transport belt 80. The fixing device 82 fixes the toner images, which have been transferred to the recording medium P, to the recording medium P by heating the toner images. A specific configuration of the fixing device 82 will be described below.

A transport belt 108, which transports the recording medium P fed from the fixing device 82 to the downstream side, is disposed on the downstream side of the fixing device 82. The transport belt 108 is formed in the same manner as each transport belt 70 is.

A cooling device 100, which transports the recording medium P heated by the fixing device 82 and cools the recording medium P, is disposed on the downstream side of the transport belt 108. A correcting device 170, which transports the recording medium P while nipping the recording medium P to correct a bend (curling) of the recording medium P, is disposed on the downstream side of the cooling device 100.

A detecting device 180 is disposed on the downstream side of the correcting device 170. The detecting device 180 detects a toner density defect, an image defect, an image position defect, or other defects of the toner images that are fixed to the recording medium P. The detecting device 180 detects such defects by detecting a reflected light, which has been emitted from a light source to the recording medium P and then reflected upward by the recording medium P, using a detecting element such as a charge coupled device (CCD) image sensor.

Output rollers 198 are disposed on the downstream side of the detecting device 180. The output rollers 198 output the recording medium P, having an image formed on one surface, to an output unit 196 that is attached to a side surface of the second housing 10B.

In the case of forming images on both surfaces of a recording medium P, the recording medium P fed from the detecting device 180 is transported to a reversing path 202 that is disposed on the downstream side of the detecting device 180. The reversing path 202 includes a branching path 202A that branches from the transport path 60, a transport path 202B along which the recording medium P that has been transported from the branching path 202A is transported toward the first housing 10A, and a reversing path 202C along which the recording medium P that has been transported from the transport path 202B is transported in the reverse direction in a switchback manner and thus the recording medium P is turned upside down.

In this configuration, the recording medium P that has been transported in a switchback manner along the reversing path 202C is transported toward the first housing 10A, travels further along the transport path 60 above the recording-medium containing portions 48, and is transported back to the second transfer position T2, again.

Image Forming Process Performed by Image Forming Apparatus 10

An image forming process performed by the image forming apparatus 10 will be described now.

Image data that has been subjected to image processing by the image signal processor 13 is transmitted to the exposure units 40. Each exposure unit 40 emits exposure light L in accordance with the image data and exposes a corresponding photoconductor 18 that has been charged by a corresponding scorotron charger 20 to form an electrostatic latent image. The electrostatic latent image formed on the photoconductor 18 is developed by a corresponding developing device 22 to form a toner image with a color of the first extra color (V), the second extra color (W), yellow (Y), magenta (M), cyan (C), or black (K).

The toner images having different colors and formed on the photoconductors 18 of the image forming units 16V, 16W, 16Y, 16M, 16C, and 16K are sequentially transferred to the intermediate transfer belt 34 by the six first transfer rollers 36V, 36W, 36Y, 36M, 36C, and 36K so as to be stacked on top of one another. The toner images having different colors and transferred to the intermediate transfer belt 34 so as to be stacked on top of one another are second-transferred by the second transfer roller 62 to a recording medium P that has been transported from any of the recording-medium containing portions 48.

The recording medium P having the toner images transferred thereto is transported by the transport belts 70 toward the fixing device 82 that is disposed in the second housing 10B. When the toner images with different colors on the recording medium P are heated and compressed by the fixing device 82, the toner images are fixed to the recording medium P.

After the recording medium P having the toner images fixed thereto passes through the cooling device 100 and is cooled down, the recording medium P is fed to the correcting device 170 and a bend occurring in the recording medium P is corrected. The recording medium P that has been subjected to a correcting operation is transported to the detecting device 180, and the detecting device 180 detects whether there is any defect, including an image defect, on the recording medium P. Then, the recording medium P is output to the output unit 196 by the output rollers 198.

The case is considered where another image is formed on a blank surface (back surface) that has no image formed thereon (the case of two-sided printing). After a recording medium P passes through the detecting device 180, the recording medium P is reversed on the reversing path 202 and fed to the transport path 60 above the recording-medium containing portions 48. Then, a toner image is formed on the back surface in the same manner as described above.

Specific Configuration of Fixing Device 82

Figure 3:
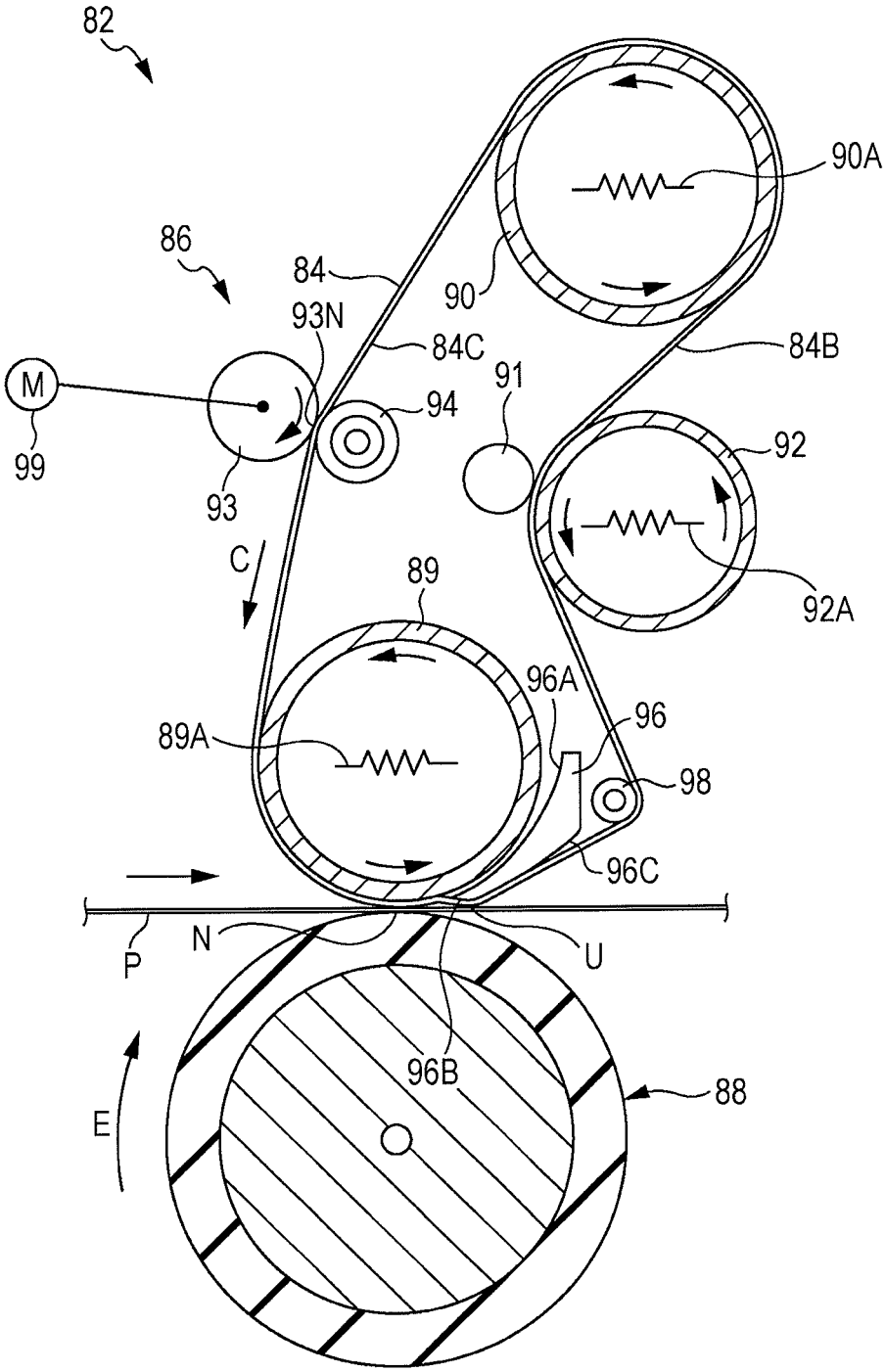
FIG. 3 is a schematic diagram illustrating a configuration of a fixing device according to the exemplary embodiment.
Figure 4:
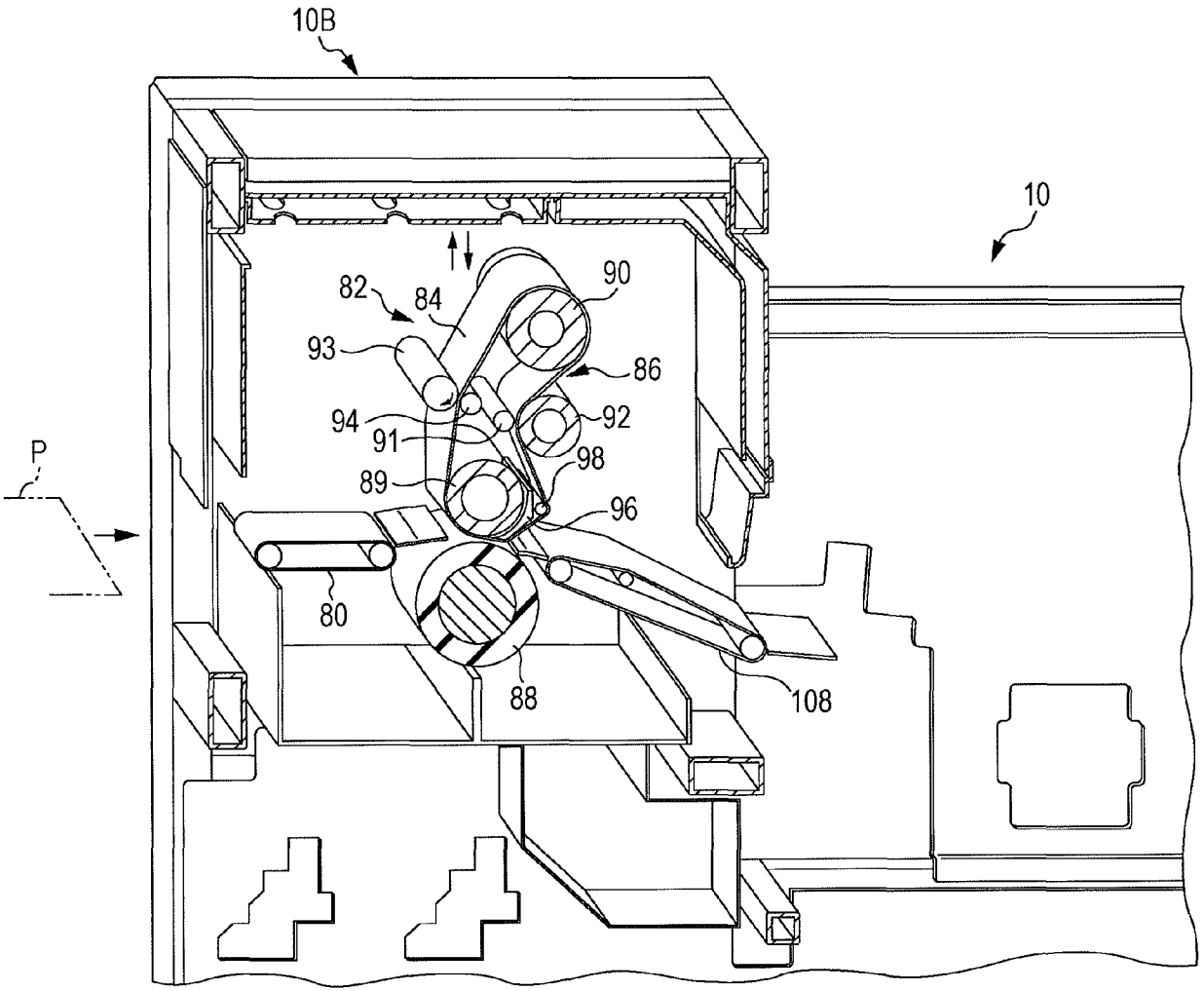
FIG. 4 is a perspective diagram illustrating the configuration of the fixing device according to the exemplary embodiment.

Now, a specific configuration of the fixing device 82 according to the exemplary embodiment will be described. FIGS. 3 and 4 are schematic diagrams illustrating a configuration of the fixing device 82 according to the exemplary embodiment.

As illustrated in FIGS. 3 and 4, the fixing device 82 includes a fixing belt module 86, which includes a fixing belt 84, and a compression roller 88, which is disposed so as to be pressed against the fixing belt module 86. A nip portion (contact portion) N at which the fixing belt 84 (fixing belt module 86) and the compression roller 88 are in contact with each other is formed between the fixing belt 84 (fixing belt module 86) and the compression roller 88. When the recording medium P passes through the nip portion N, the recording medium P is compressed and heated by the compression roller 88 and the fixing belt 84, so that the toner images are fixed to the recording medium P.

The fixing belt module 86 includes the fixing belt 84, which is an endless belt, a fixing roller 89, and an inner heating roller 90. The fixing belt 84, which is an example of a heater, fixes toner images formed on the recording medium P to a recording medium P by heating the toner images, while rotationally moving and transporting the recording medium P. The fixing belt 84 is wound around the fixing roller 89 and the inner heating roller 90. The fixing roller 89 is disposed on a side that is close to the compression roller 88, and driven so as to rotate by a rotational force of a motor (not illustrated). The inner heating roller 90 is disposed at a position that is on an inner peripheral side of the fixing belt 84 but different from the position of the fixing roller 89.

The fixing belt module 86 also includes an outer heating roller 92 and a support roller 94. The outer heating roller 92 is disposed on the outer peripheral side of the fixing belt 84 and defines a rotating path of the fixing belt 84. The support roller 94 is disposed on the inner peripheral side of the fixing belt 84 between the fixing roller 89 and the inner heating roller 90. In this exemplary embodiment, an opposing roller 91, which opposes the outer heating roller 92 with the fixing belt 84 interposed therebetween, is disposed on the inner peripheral side of the fixing belt 84.

The inner heating roller 90 also serves as a steering roller used to adjust belt walk of the fixing belt 84. The inner heating roller 90 adjusts belt walk of the fixing belt 84 in the following manner. Specifically, an end portion of the inner heating roller 90 in the axial direction is moved in the radial direction (for example, a far-side end portion in FIG. 4 is vertically moved) with respect to the other end portion of the inner heating roller 90 in the axial direction so that the axial direction is angled differently. In this manner, the fixing belt 84 is moved in the width direction that intersects the rotating direction of the fixing belt 84. Consequently, the inner heating roller 90 functions as an example of a moving device that moves the fixing belt 84 with respect a refreshing roller 93, which will be described below, in a direction of the rotational axis of the refreshing roller 93.

As illustrated in FIG. 3, halogen lamps 89A, 90A, and 92A are respectively disposed inside the fixing roller 89, the inner heating roller 90, and the outer heating roller 92 as examples of heating sources. The fixing roller 89 and the inner heating roller 90 are in contact with an inner peripheral surface 84C of the fixing belt 84 to heat the fixing belt 84 from inside, and the outer heating roller 92 is in contact with an outer peripheral surface 84B of the fixing belt 84 to heat the fixing belt 84 from outside.

A separating pad 96 and a support roller 98 are disposed on the inner side of the fixing belt 84 at portions that are located on the downstream side of the nip portion N, at which the compression roller 88 is pressed against the fixing belt 84 of the fixing belt module 86. The separating pad 96 is disposed near the fixing roller 89 and separates the fixing belt 84 from an outer peripheral surface of the fixing roller 89. The fixing belt 84 is wound around the support roller 98 at a portion that is located on the downstream side of the nip portion N.

The separating pad 96 is, for example, a block member that is formed of a rigid body made of a ferrous metal, a resin, or other materials. The length of the separating pad 96 in the axial direction is equivalent to that of the fixing roller 89. The separating pad 96 generally has an arc shape in cross section, and includes an inner-side surface 96A that is curved so as to face the fixing roller 89, a pressing surface 96B that presses the fixing belt 84 against the compression roller 88, and an outer-side surface 96C that forms a predetermined angle with the pressing surface 96B and bends the fixing belt 84. Specifically, a portion of the fixing belt 84 that is pressed by the compression roller 88 against a corner portion U, which is formed between the pressing surface 96B and the outer-side surface 96C, is bent at the corner portion U. Thus, the fixing belt 84 becomes separated from a leading end of the recording medium P when the leading end of the recording medium P passes the corner portion U.

Fixing Process Performed by Fixing Device 82

Now, a fixing process performed by the fixing device 82 will be described.

As illustrated in FIG. 3, a recording medium P having had toner images transferred thereto at the second transfer position T2 (see FIG. 1) is fed to the nip portion N by the transport belt 80 (see FIG. 1).

The fixing roller 89 is rotated by a driving for e supplied from a driving source (not illustrated) such as a motor. The fixing belt 84 is driven so as to rotate in the arrow C direction by the rotation of the fixing roller 89. In addition, the compression roller 88 is driven so as to rotate in the arrow E direction by the rotation of the fixing belt 84.

The recording medium P that arrives at the nip portion N is transported to the downstream side by the rotating fixing belt 84 and the rotating compression roller 88. The recording medium P is heated and compressed by the fixing belt 84 and the compression roller 88 at the nip portion N. Consequently, the toner images are fixed to the recording medium P. Here, the recording medium P is heated by the fixing belt 84, which is heated by the fixing roller 89, the inner heating roller 90, and the outer heating roller 92.

The fixing belt 84 that has passed through the nip portion N is bent by being pressed against the corner portion U, which is formed between the pressing surface 96B and the outer-side surface 96C of the separating pad 96. When a leading end portion of the recording medium P passes the corner portion U, the recording medium P becomes separated from the fixing belt 84 due to a so-called "stiffness" of the recording medium P.

Refreshing Roller 93

In this exemplary embodiment, as illustrated in FIG. 3, a refreshing roller 93 is disposed so as to oppose the support roller 94 with the fixing belt 84 interposed therebetween. The fixing belt 84 rotates in a first direction. The refreshing roller 93 is an example of a reducing member that reduces irregularities on the outer peripheral surface of the fixing belt 84 by rotating in a second direction that is different from the first direction. The refreshing roller 93 rotates at a peripheral velocity that is different from that of the fixing belt 84 and scratches the outer peripheral surface of the fixing belt 84.

The refreshing roller 93 scratches the outer peripheral surface of the fixing belt 84 and thus forms a number of fine scratches on a portion of the surface of the fixing belt 84 that has been roughened by the recording medium P passing thereover and on a portion of the surface that has not been roughened. The fine scratches are formed so that unevenness glossiness (or glossiness difference) in the images, which have been fixed to the recording medium P by the fixing belt 84 and the compression roller 88, is not visually recognizable. In other words, the refreshing roller 93 forms scratches on the surface of the fixing belt 84 without substantially scraping off any of the surface of the fixing belt 84. The refreshing roller 93 roughens the surface of the fixing belt 84 to a desired level to make the surface even (to reduce irregularities on the surface). Thus, the unevenness in glossiness in the images is removed.

The refreshing roller 93 is formed by densely attaching abrasive grains to a core shaft (base material), which is made of a stainless steel or the like. Here, the densely attached abrasive grains serve as a surface layer of the refreshing roller 93. The abrasive grains are made of a material such as aluminum oxide, aluminum oxide hydroxide, silicon oxide, cerium oxide, titanium oxide, zirconia, lithium silicate, silicon nitride, silicon carbide, iron oxide, chromium oxide, antimony oxide, diamond, or a compound containing any of these. In this exemplary embodiment, alumina (aluminum oxide) is adopted as a material of the abrasive grains.

The refreshing roller 93 is rotatably supported by supporting members (not illustrated) that are disposed at both end portions of the refreshing roller 93 in the longitudinal direction (axial direction), and is driven so as to rotate by a motor 99, which serves as a driving device. The supporting members at both the end portions in the longitudinal direction of the refreshing roller 93 are urged by compression springs (not illustrated), which serve as urging devices, and thus the refreshing roller 93 is pressed against the fixing belt 84 with a predetermined pressure. Thus, a contact portion (nip portion) 93N having a predetermined width in a direction in which each of the refreshing roller 93 and the fixing belt 84 moves on the surface of the other is formed between the refreshing roller 93 and the fixing belt 84.

In this exemplary embodiment, the refreshing roller 93 rotates in the second direction, which is different from the first direction in which the fixing belt 84 rotates, at a peripheral velocity that is different from that of the fixing belt 84 so as to form scratches having a length in the peripheral direction (referred to as "peripheral length", below) ranging from 200 μm to 300 μm, inclusive, or ranging from about 200 μm to about 300 μm on the outer peripheral surface of the fixing belt 84.

Here, the peripheral length of each scratch formed by a corresponding abrasive grain is calculated by the following equations:

A peripheral length of each scratch=$|V_{Roll}-V_{belt}|$×time that the abrasive grain is in contact with the fixing belt 84=$|1-1/(r/100+1)|$×the width of the contact portion 93N, Time that the abrasive grain is in contact with the fixing belt 84=the width of the contact portion 93N/$V_{Roll}$, r (percentage peripheral velocity difference)=$(V_{Roll}-V_{belt})/V_{belt}\times 100$, $V_{Roll}$=the peripheral velocity of the fixing belt 84, $V_{belt}$=the peripheral velocity of the refreshing roller 93.

Figure 5:
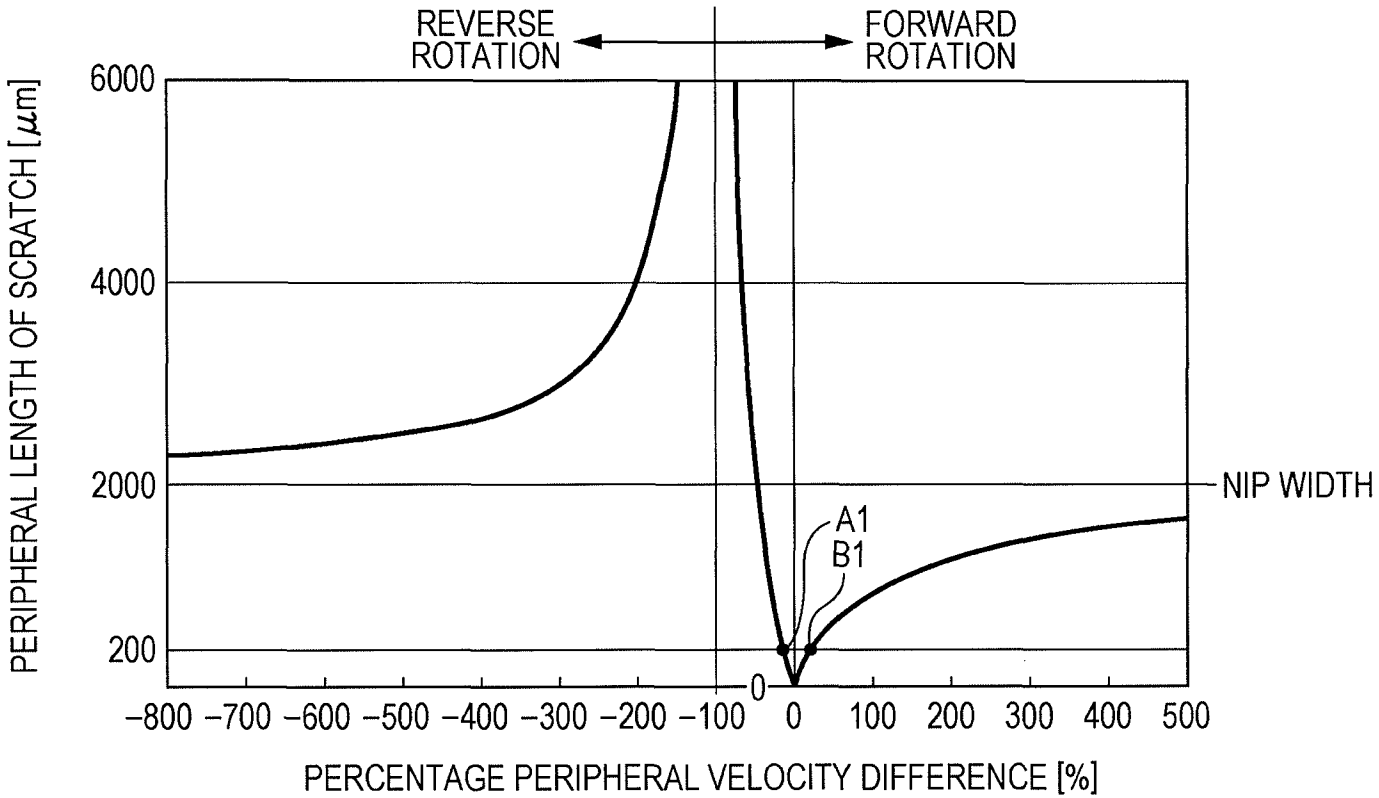
FIG. 5 is a graph illustrating a relationship between the percentage difference of the peripheral velocity of a refreshing roller from that of a fixing belt and a length of a scratch in the peripheral direction.

FIG. 5 is a graph strafing a relationship between the percentage difference of the peripheral velocity of the refreshing roller 93 from that of the fixing belt 84 (simply referred to as "the percentage peripheral velocity difference", below) and the peripheral length of scratches. The percentage peripheral velocity difference r is calculated using one of the above equations. When the percentage peripheral velocity difference is "−100%", the refreshing roller 93 is stationary (not rotating). When the percentage peripheral velocity difference is "lower than −100%", the refreshing roller 93 and the fixing belt 84 are rotating in the same direction. When the percentage peripheral velocity difference is "over −100%", the refreshing roller 93 is rotating in the second direction that is different from the first direction in which the fixing belt 84 rotates. When the percentage peripheral velocity difference is "0%", the refreshing roller 93 is rotating in the second direction that is different from the first direction in which the fixing belt 84 rotates and the refreshing roller 93 is rotating at the same peripheral velocity as the fixing belt 84.

In the case where the width of the contact portion 93N (or referred to as nip width) is 2,000 μm, the peripheral length of scratches is approximately 200 μm when the percentage peripheral velocity difference is "−9%" (at the point A1 in FIG. 5), and the peripheral length of scratches is approximately 300 μm when the percentage peripheral velocity difference "−13%". In the case where the width of the contact portion 93N (or referred to as nip width) is 2,000 μm, the peripheral length of scratches is approximately 200 μm when the percentage peripheral velocity difference is "+11%" (at the point B1 in FIG. 5), and the peripheral length of scratches is approximately 300 μm when the percentage peripheral velocity difference is "+17.5%". In this exemplary embodiment, the refreshing roller 93 is configured to rotate in the second direction while the percentage peripheral velocity difference is maintained within "the range from −9% to −13%, inclusive", and "the range from +11% to +17.5%, inclusive", to form scratches having a peripheral length ranging from 200 μm to 300 μm, inclusive, or ranging from about 200 μm to about 300 μm on the outer peripheral surface of the fixing belt 84.

When the peripheral length of scratches exceeds 300 μm, the unevenness in glossiness generated after the individual scratches are formed may reach the resolution of an unevenness in glossiness that a human being is capable of visually recognizing. If, instead, scratches become connected to one another in the peripheral direction, unevenness in glossiness may be generated in a streak-like form. In view of the above, in this exemplary embodiment, the peripheral length or each scratch is set to 300 μm or less so that the unevenness in glossiness generated after the individual scratches are formed does not reach the resolution of an unevenness in glossiness that a human being is capable of visually recognizing, and so that unevenness in glossiness is not generated in a streak-like form even when scratches become connected to one another.

On the other hand, if the peripheral length of scratches is lower than 200 μm, the processing time required to form the scratches over the entire surface of the fixing belt 84 (the number of rotations of the fixing belt 84) to effectively make the entire surface of the fixing belt 84 uniform may exceed the allowable level. For this reason, in this exemplary embodiment, the peripheral length of scratches is set to 200 μm or more so that the processing time required to effectively make the entire surface of the fixing belt 84 uniform does not exceed the allowable level.

Figure 6A:
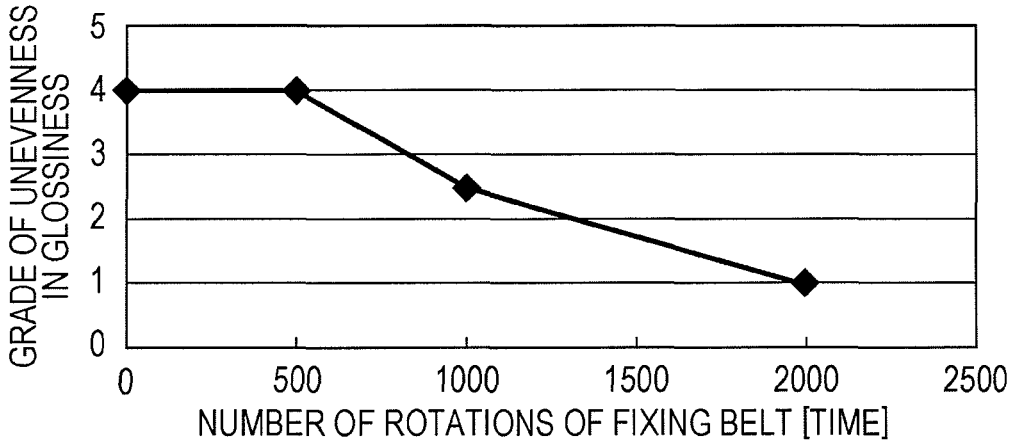
FIGS. 6A and 6B are graphs illustrating reductions of unevenness of glossiness for the case where the length of scratches in the peripheral direction is 200 μm.
Figure 6B:
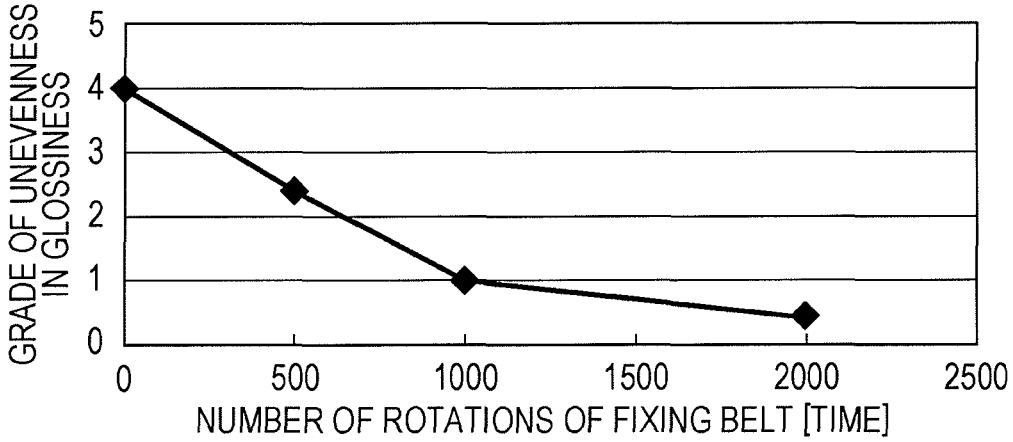

FIGS. 6A and 6B are graphs illustrating reductions of unevenness in glossiness for the case where the peripheral length of scratches is 200 μm. The horizontal axis indicates a number of rotations of the fixing belt 84, and the vertical axis indicates a grade of unevenness in glossiness. The grade of unevenness in glossiness is visually evaluated by people, and the smaller the number, the higher the grade. When the grade is zero, an image fixed by the fixing device 82 has no unevenness in glossiness. When the grade is one or lower, an image fixed by the fixing device 82 has unevenness in glossiness that is at the allowable level. Here, a surface pressure of the refreshing roller 93 against the fixing belt 84 is 2 kg/cm$^2$, and a diameter of the abrasive grains of the refreshing roller 93 is 3.4 μm.

As illustrated in FIG. 6A, when the percentage peripheral velocity difference is "−9%", the unevenness in glossiness reaches the grade 1 or lower after the fixing belt 84 has rotated 2,000 times. As illustrated in FIG. 6B, when the percentage peripheral velocity difference is +11%, the unevenness in glossiness reaches the grade 1 or lower after the fixing belt 84 has rotated 1,000 times. In both cases, the number of rotations of the fixing belt 84 is 2,000 or lower, which is at the allowable level.

It is found from these results that, in the case where the percentage peripheral velocity difference falls within "the range from +11% to +17.5%, inclusive", an effect of making the entire surface of the fixing belt 84 uniform by forming a large number of scratches on the fixing belt 84 is obtained with time that is shorter than that in the case where the percentage peripheral velocity difference falls within "the range from −9% to −13%, inclusive". In the case of the fixing device 82 according to the exemplary embodiment, it takes about ten minutes for the fixing 84 to rotate 500 times.

Operation of Refreshing Roller 93

In this exemplary embodiment, the refreshing roller 93 rotates in the second direction, which is different from the first direction in which the fixing belt 84 rotates, at a peripheral velocity that is different from that of the fixing belt 84 to form scratches over the entirety of the outer peripheral surface of the fixing belt 84 and to reduce irregularities on the outer peripheral surface. Here, the refreshing roller 93 rotates while moving in the width direction that intersects the rotating direction of the fixing belt 84.

Since the refreshing roller 93 moves in the width direction, which intersects the rotating direction of the fixing belt 84, and forms scratches on the fixing belt 84, the scratches formed on the fixing belt 84 by the refreshing roller 93 are spread out in the width direction of the fixing belt 84. Thus, the refreshing roller 93 more evenly scratches the outer peripheral surface of the fixing belt 84 (more evenly forms scratches on the outer peripheral surface). Moreover, when scratches are formed so as to be spread out in the width direction of the fixing belt 84, the scratches are less likely to become connected to one another in the peripheral direction, and thus unevenness in glossiness is less likely to be generated in a streak-like form.

In this exemplary embodiment, the refreshing roller 93 rotates in the second direction, which is different from the first direction in which the fixing belt 84 rotates, at a peripheral velocity that is different from that of the fixing belt 84 so as to form scratches having a peripheral length ranging from 200 μm to 300 μm, inclusive, or ranging from about 200 μm to about 300 μm on the outer peripheral surface of the fixing belt 84. Since the peripheral length of each scratch is 300 μm or less, the unevenness in glossiness generated after the individual scratches are formed does not reach the resolution of an unevenness in glossiness that a human being is capable of visually recognizing, or unevenness in glossiness is not generated in a streak-like form even when scratches become connected to one another. Since the peripheral length of scratches is 200 μm or more, the processing time required to effectively make the entire surface of the fixing belt 84 uniform does not exceed the allowable level. In short, when the peripheral length of scratches falls within the range from 200 μm to 300 μm, inclusive or the range of approximately 200 μm to 300 μm, it takes short a time to entirely form the scratches on the outer peripheral surface of the fixing belt 84, while the unevenness in glossiness generated after the individual scratches are formed is kept low.

Modifications

In this exemplary embodiment, the fixing belt 84 is adopted as a heater, but instead, a fixing roller may be adopted as a heater. In the configuration that includes a fixing roller, for example, the fixing roller is moved in the axial direction with respect to the refreshing roller 93 by moving supporting portions, which support both end portions of the fixing roller in the axial direction so that the fixing roller is made rotatable, in the axial direction by using a moving mechanism.

In this exemplary embodiment, the refreshing roller 93 rotates in the second direction at a peripheral velocity that is different from that of the fixing belt 84 so as to form scratches having a peripheral length ranging from 200 μm to 300 μm, inclusive, or ranging from about 200 μm to about 300 μm on the outer peripheral surface of the fixing belt 84. However, the refreshing roller 93 may rotate in the second direction at a peripheral velocity that is different from that of the fixing belt 84 so as to form scratches having a peripheral length that exceeds the range from 200 μm to 300 μm.

The present invention is not limited to the exemplary embodiment described above, but may be modified, changed, or improved in various manners. For example, the modifications described above may combined.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a heater that transports a recording medium while rotating in a first direction and fixes an image formed on the recording medium to the recording medium by heating the image;

a reducing member that rotates in a second direction different from the first direction, the reducing member and the heater contacting each other and rotating at different speeds, and the reducing member scratching an outer peripheral surface of the heater; and a moving device that moves the heater with respect to the reducing member in a direction of a rotational axis of the reducing member, wherein an outer surface of the reducing member moves in a same direction as the outer peripheral surface of the heater.

2. The fixing device according to claim 1, wherein a scratch formed on the outer peripheral surface of the heater by the reducing member has a length ranging from about 200 μm to about 300 μm in a peripheral direction of the heater.

3. An image forming apparatus comprising:

an image forming device that forms an image on a recording medium; and the fixing device according to claim 1 that fixes the image formed on the recording medium by the image forming device, to the recording medium.

4. An image forming apparatus comprising:

an image forming device that forms an image on a recording medium; and the fixing device according to claim 2 that fixes the image formed on the recording medium by the image forming device, to the recording medium.

5. A fixing device comprising:

a fixing member that includes a roller and a belt and fixes an image on a recording medium to the recording medium by heating the image, the belt being wound around the roller and rotating in a first direction; and a scratch roller that rotates in a second direction different from the first direction while contacting the belt and forms a scratch on an outer peripheral surface of the belt, wherein the scratch roller and the belt rotate at different speeds, and the scratch roller moves in a direction that intersects a peripheral direction of the belt rotation.

6. The fixing device according to claim 5, wherein the scratch has a length ranging from about 200 μm to about 300 μm in the peripheral direction of the belt.

7. The fixing device according to claim 5, wherein a rotating speed of the scratch roller is greater than a rotating speed of the belt.

8. The fixing device according to claim 5, wherein an abrasive layer is formed on a surface of the scratch roller.

9. An image forming apparatus comprising:

an image forming device that forms an image on a recording medium; and the fixing device according to claim 5.

10. The fixing device according to claim 5, wherein the scratch roller moves in a direction that intersects a peripheral direction of the belt at an angle.

* * * * *